United States Patent [19]

Simeth et al.

[11] Patent Number: 4,873,926

[45] Date of Patent: Oct. 17, 1989

[54] CLAMPING GRIPPER WITH RESULTANT FORCE THROUGH CONTACT POINT

[75] Inventors: Claus Simeth, Offenbach am Main; Valentin Gensheimer, Muhlheim am Main, both of Fed. Rep. of Germany

[73] Assignee: MAN Poland Druckmaschinen AG, Fed. Rep. of Germany

[21] Appl. No.: 101,287

[22] Filed: Sep. 25, 1987

[30] Foreign Application Priority Data

Sep. 26, 1986 [DE] Fed. Rep. of Germany ..... 3632768

[51] Int. Cl.[4] ..... B41F 21/04; B41F 1/30

[52] U.S. Cl. ..... 101/409; 271/277

[58] Field of Search ..... 101/408, 409, 410, 411, 101/412; 271/277, 82

[56] References Cited

U.S. PATENT DOCUMENTS

| | | | |
|---|---|---|---|
| 2,599,776 | 6/1952 | Peyrebrume | 101/409 |
| 2,928,344 | 3/1960 | Dietrich et al. | 101/412 |
| 2,933,040 | 4/1960 | Helmig | 101/412 |
| 3,650,211 | 3/1972 | Nentwich | 101/409 |
| 4,718,342 | 1/1988 | Raab et al. | 101/409 |
| 4,718,343 | 1/1988 | Gensheimer et al. | 101/409 |

FOREIGN PATENT DOCUMENTS

| | | | |
|---|---|---|---|
| 1174804 | 7/1964 | Fed. Rep. of Germany | 101/412 |
| 3526252 | 3/1986 | Fed. Rep. of Germany | 101/409 |
| 1180547 | 2/1970 | United Kingdom | 101/409 |

*Primary Examiner*—Clifford D. Crowder

*Attorney, Agent, or Firm*—Leydig, Voit & Mayer

[57] ABSTRACT

A clamping gripper for sheet-fed rotary printing presses wherein tensions produced in the paper by adhesion forces of the blanket do not react in run-on shifts of the center of a main gripper member mounted for rotation with a fit clearance on the gripper shaft. A spring is so disposed, and the bearing plane and the gripper support surface are so inclined relative to one another, that the resultant force due to the spring force, thrust and bearing load intersect the gripper finger at the transfer point.

1 Claim, 1 Drawing Sheet

CLAMPING GRIPPER WITH RESULTANT FORCE THROUGH CONTACT POINT

FIELD OF THE INVENTION

The present invention relates generally to a clamping gripper for sheet-fed rotary printing presses.

BACKGROUND OF THE INVENTION

Resilient sheet grippers are widely used in printing presses to grip a sheet of paper and hold it against a cylinder. If the paper is pulled out of the gripper even slightly, problems arise with mackling and registration errors occur.

A gripper system of this general kind is disclosed in DE-PS 1 174 804 wherein the main gripper member of a clamping gripper is in the form of a half-shell with one end connected to a spring base on the clamping element. The other end bears, with the gripper closed, on the gripper support and, with the gripper open, on a bearing abutment.

A disadvantage in this type of gripper is that the resultant of the forces acting in the gripper system does not pass through the place on the gripper finger where the sheet is transferred. Consequently, a gripper of this kind remains sensitive to accidental changes in the direction of the bearing load which leads to a change in the direction of the resultant and to a shift of the dynamic bearing point between the gripper shaft and the bearing bore of the rotating main gripper member. While in operation, the gripper shifts because of changes in the center of the bearing fit clearance. The accidental changes in direction of the bearing load may be caused, for example, by changing high paper tensions due to the sheet being separated from the blanket of the blanket cylinder at the bend angle.

In the gripper disclosed in DE-OS 3 526 252, a second spring is provided to compensate for changing bearing forces. This gripper, however, also remains sensitive to unintended changes in bearing load direction.

In yet another type of gripper, as shown in FIG. 1 of U.S. Pat. No. 2,933,040, gripper members are formed with a closed bearing bore and mounted rotatably on the gripper shaft and resiliently suspended on a clamping member. The bearing fit, however, cannot be very fine since the bearing zone on the gripper shaft is not lubricated and cannot be protected against the entry of paper dust and powder. Because of the rapid but only short-distance movement of the main gripper member relative to the gripper shaft, the grippers lose their resiliency. Since this and the associated damage of the expensive gripper shaft must be avoided, considerable bearing play is often allowed. In this case, it becomes impossible for the grippers to transfer sheets in accurate registration since the static load point with the gripper open differs from the dynamic load point with the gripper closed, so that shifts in the center of the bearing clearance occur continuously.

OBJECTS AND SUMMARY OF THE INVENTION

It is a primary object of the present invention to provide a clamping gripper in which the resultant of the forces arising in the gripper system passes through the point of sheet transfer on the gripper finger.

An additional object of the present invention is to provide a gripper having a bearing point between the bearing bore of the main gripper member and the gripper shaft which remains operative in run-on irrespective of the size and direction of the tension forces in the paper produced by adhesion forces of the blanket.

A further object of the present invention is to provide a clamping gripper that has as favorable oscillatory behavior as a short gripper having a high natural frequency and a small amplitude.

The above is accomplished, according to the present invention, by providing a clamping gripper for sheet-fed rotary printing presses wherein tensions produced in the paper by adhesion forces of the blanket do not react in run-on shifts of the center of a main gripper member mounted for rotation with a bearing clearance on the gripper shaft. Additionally, a spring is so disposed, and the bearing plane and the gripper support surface are so inclined relative to one another, that the resultant force due to the spring force, thrust and bearing loads intersect the gripper finger at the transfer point.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENTS

Figure 1:
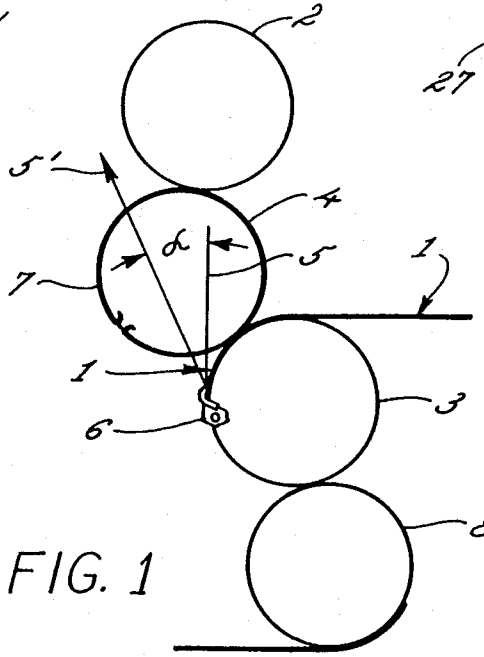
FIG. 1 is a cross-sectional view showing a sheet which is being removed from a printing press blanket cylinder with the consequent bend angle and shows the immediate environment in which a device according to the present invention is used.

Turning now to the drawings, FIG. 1 shows a sheet 1 required to be separated from a blanket cylinder 4 cooperating with a plate cylinder 2 and an impression cylinder 3 of a rotary printing press. A delivery drum 8 is also shown.

The detachment of sheet 1 from blanket cylinder 4 occurs at the bend angle and with tensile stresses 5, 5' in the paper. The forces 5, 5' act in variable amounts and directions on the finger 15 of the gripper 6 due to the varying blanket, sheet and press characteristics.

Figure 3:
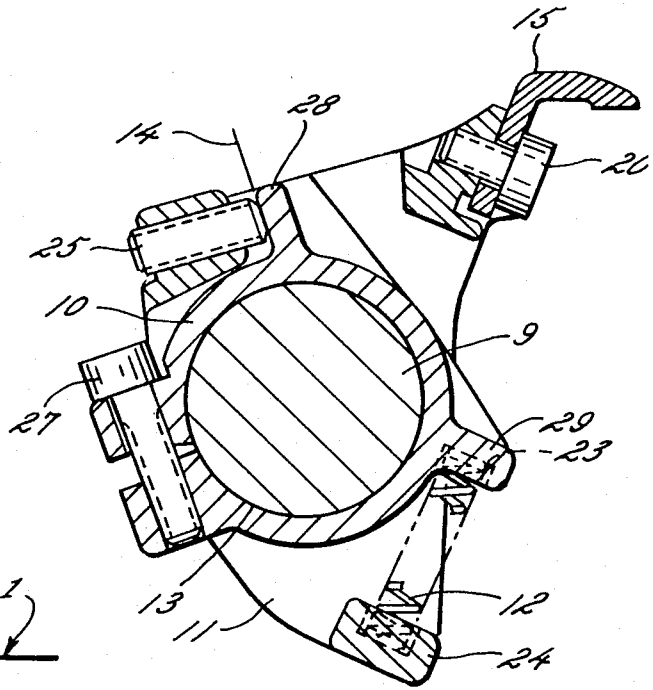
FIG. 3 is an enlarged view, similar to FIG. 2, showing additional features of a device according to the invention.
Figure 2:
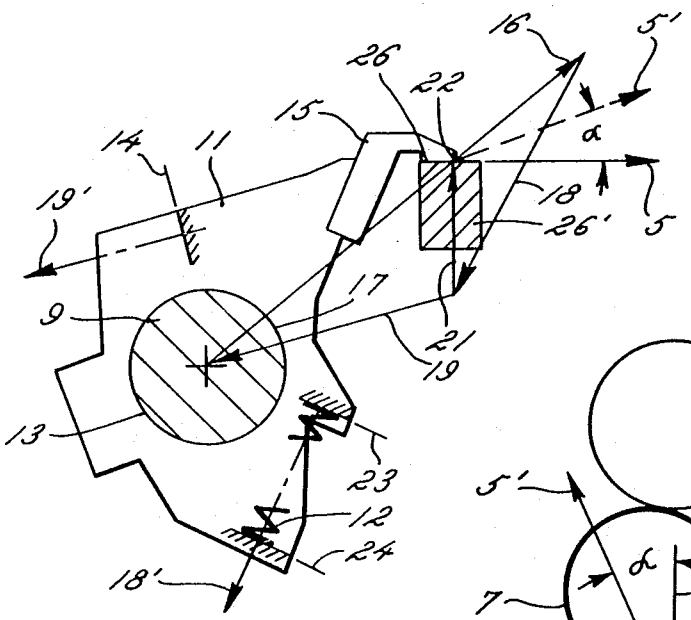
FIG. 2 is a cross-sectional view of a clamping gripper showing the forces operative on the gripper finger with the gripper open and with the gripper closed.

Turning to FIGS. 2 and 3, the clamping element 10 is shown secured to a oscillatory gripper shaft 9 by a clamping screw 27. The main gripper member 11 is formed with a circumferentially closed bearing bore 13 and is brought into engagement with the clamping element 10 by a spring 12 disposed substantially tangentially with respect to the gripper shaft 9. The main gripper member 11, in association with the oscillatory gripper shaft 9, is moveable between a gripping position and a non-gripping position. In the gripping position, gripper finger 15 is urged toward a gripper support surface 26 on a gripper support 26' mounted on the periphery of the press cylinder 3 so as to create a load force 21 thereon. In the non-gripping position, in order to stop the finger 15 at a predetermined distance, the stop lug 28 is urged against screw 25 disposed substantially tangentially with respect to the gripper shaft 9.

Thus, with the gripper 6 in the open state, the spring force or first tangentially extending force 18' and the thrust or second tangentially extending force 19' determine the direction of the resultant 16. Tangential forces 18' and 19' are translated in FIG. 2 to 18 and 19 for purposes of illustration and resolution thereof. With the gripper 6 in the closed state, the first radially extending force 18 and the bearing load or load force 21 determine the resultant 16'.

In accordance with the invention, a lug stop 28 and post 29 are disposed in generally radially extending relation to the gripper shaft 9 about the clamping element 11 such that, in the gripping position, the resultant of the first tangentially extending force 18 and the load force 21 intersect the transfer point 22. Additionally, in the non-gripping position, the resultant of the first and second tangential forces 18, 19 also intersect the transfer point 22.

In keeping with the invention, the circumferentially closed bearing bore 13 in the gripping member 11 always engages the gripper shaft 9 downwardly at the bearing point 17 substantially in line with the resultant 16, so that the tensions in the paper produced by the unwanted adhesion forces of the blanket cease to have any effect on the center shift of the gripper main member during run-on. Since the gripper is centered at the point 17 at a small distance from the transfer point 22, it also has the advantageous oscillatory behavior of a short gripper, such as one having a low amplitude and a high natural frequency. Both these advantages are very significant for high-speed presses.

By means of the adjusting screw 25 on the member 11, the spring 12 can be adjustably preloaded. The screw 25 is also operative as a stop screw so that the force of the spring 12 acts on a generally radial surface 23 on the post 29 of the clamping element 10 and a generally radial support surface 24 on the member 11 to press the screw 25 onto the support or bearing plane 14 on the stop lug 28 of the clamping element 10.

When the gripper finger 15 engages the sheet 1 on the gripper support surface 26, the screw 25 disengages from the plane 14 on the stop lug 28 so that the force 18 of the spring 12 is operative as a pressing force on the finger 15. The same is releasably secured to the member 11 by means of a screw 20.

We claim as our invention:

1. A clamping gripper for a sheet-fed rotary press having an oscillating gripper actuating shaft, said clamping gripper comprising, in combination:

a gripper support;

a main gripper member moveable between a gripping position and a non-gripping position and having a gripper finger urged toward said gripper support at a transfer point and effecting a load force thereon when said main gripper member is in said gripping position;

clamping means for securing said main gripper member to said gripper shaft, said clamping means including a generally radially extending post and a generally radially extending stop lug;

spring means interposed between said main gripper member and said post for exerting a first tangentially extending force;

and adjusting screw means disposed between said main gripper member and said stop lug for effecting a second tangentially extending force when said gripper member is in said non-gripping position;

said first and second tangentially extending forces being disposed so that the resultant of said forces intersects said transfer point when said gripper member is in said non-gripping position;

said load force and said first tangentially extending force being disposed so that this resultant force intersects said transfer point when said gripper member is in said gripping position; and said main gripper member having a circumferentially closed bore surrounding said gripper actuating shaft with the contact point therebetween disposed substantially along the line of said resultant forces.

* * * * *